US007000890B2

(12) United States Patent
Bell et al.

(10) Patent No.: US 7,000,890 B2
(45) Date of Patent: Feb. 21, 2006

(54) PRESSURE COMPENSATED SHEAR SEAL SOLENOID VALVE

(75) Inventors: Thomas M. Bell, Houston, TX (US); James P. McAdams, Houston, TX (US); Scott D. Ward, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 119 days.

(21) Appl. No.: 10/757,658

(22) Filed: Jan. 14, 2004

(65) Prior Publication Data

US 2005/0151099 A1 Jul. 14, 2005

(51) Int. Cl.
*F16K 31/122* (2006.01)

(52) U.S. Cl. ..... 251/62; 251/129.15; 251/325

(58) Field of Classification Search ..... 251/62, 251/129.15, 325, 1.1, 1.3
See application file for complete search history.

(56) References Cited

U.S. PATENT DOCUMENTS

| | | | | |
|---|---|---|---|---|
| 4,337,829 A | | 7/1982 | Banzoli et al. | 166/366 |
| 4,607,701 A | * | 8/1986 | Gundersen | 166/368 |
| 4,637,419 A | * | 1/1987 | Hughes | 251/63.6 |
| 4,650,151 A | * | 3/1987 | McIntyre | 251/62 |
| 4,699,355 A | * | 10/1987 | Tomlin et al. | 251/62 |
| 5,778,918 A | * | 7/1998 | McLelland | 251/325 |
| 6,161,618 A | | 12/2000 | Parks et al. | 166/351 |
| 6,318,408 B1 | | 11/2001 | Fukano et al. | 137/625.44 |
| 6,484,806 B1 | | 11/2002 | Childers et al. | 166/351 |

* cited by examiner

*Primary Examiner*—John Bastianelli
(74) *Attorney, Agent, or Firm*—Conley, Rose P.C.; Peter Bielinski

(57) ABSTRACT

A pressure compensated shear seal solenoid valve for use in subsea control systems is disclosed utilizing an arcuate cross section fluid passageway to improve flow rates, ease of serviceability and reduce size.

22 Claims, 8 Drawing Sheets

Fig. 5
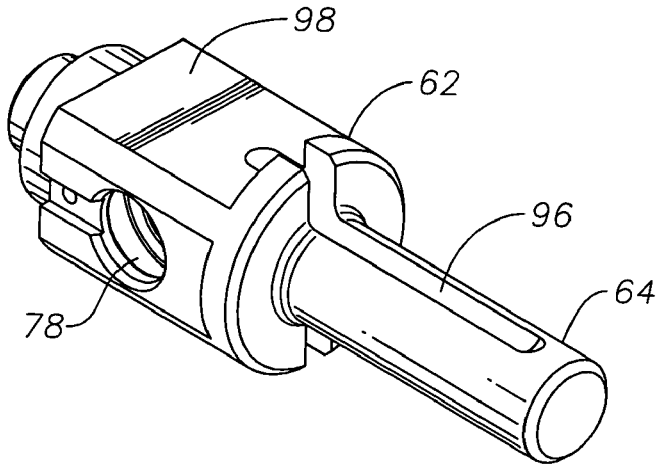
Fig. 6
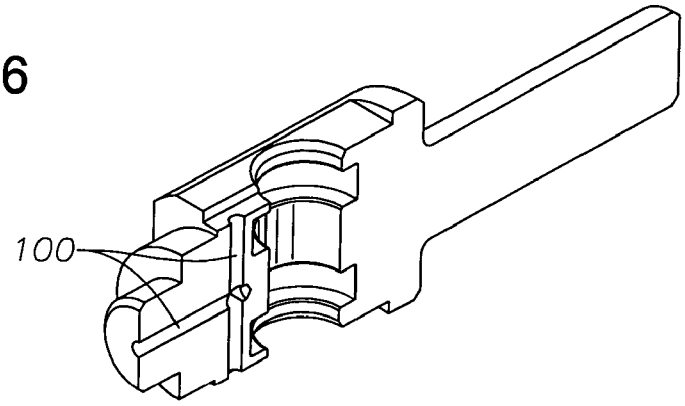
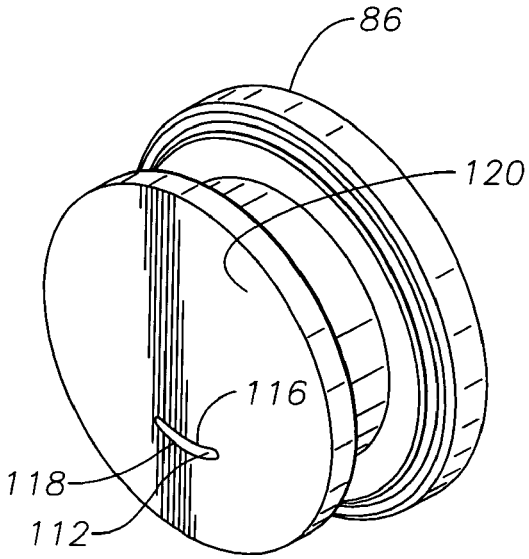
Fig. 7
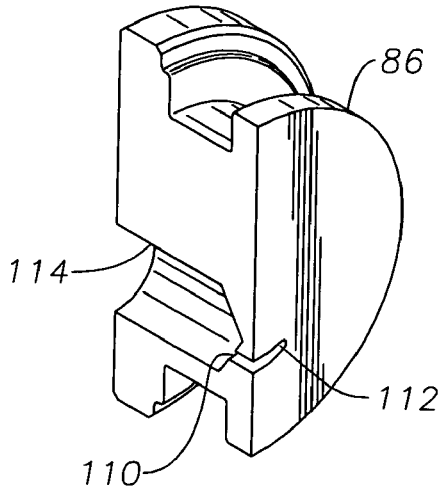
Fig. 8

PRESSURE COMPENSATED SHEAR SEAL SOLENOID VALVE

BACKGROUND OF THE INVENTION

1. Field of the Invention

This invention relates to a pressure compensated shear seal solenoid valve used in subsea hydraulic control systems for operating valves, blowout preventers and hydraulically actuated wellhead connectors. Such devices require pressurized hydraulic fluid, typically operated at 1500 or 3000 psi, for their operation. The solenoid valve of the present invention is used in the control of the flow of such pressurized hydraulic fluid.

These subsea hydraulic control systems typically consist of a group of accumulator bottles in which the pressurized hydraulic control fluid is stored, a control unit for operating the aforementioned solenoid valves, and high pressure lines or hoses to carry the hydraulic control fluid from the accumulator bottles to the control unit and its solenoid valves and thence to the function, such as open or close, of the designated valve, blowout preventer or wellhead connector. The pressurized hydraulic control fluid is stored in the accumulator bottles at the desired operating pressure of 1500 or 3000 psi.

Previous designs in the industry have suffered from such deficiencies as inadequate flow rates, unreliable operation, difficulty to service or repair and being too large which causes difficulties in fitting the required number of valves in the allowable space. It is therefore desirable to have a solenoid valve that offers improved flow rates over existing designs, ease of serviceability and reduced size for ease in designing hydraulic control systems. The pressure compensated shear seal solenoid valve of the present invention offers a substantial improvement by offering a solenoid valve that yields a substantially improved flow rate, ease of serviceability and reduced size.

2. Description of Related Art

U.S. Pat. No. 4,337,829 to V. Banzoli et al. shows a control system for subsea wellheads that comprises an electronic command and control unit, a valve actuating hydraulic electric unit, a power generator unit and interconnection devices for interconnecting the hydraulic lines for controlling the system from the surface.

A subsea control module is disclosed in U.S. Pat. No. 6,161,618 to W. C. Parks et al. The subsea control module consists of a lower portion with plate for carrying hydraulic couplings and hydraulic passages from valves to couplings, a one atmosphere dry nitrogen purged chamber in a pressure vessel dome contains electronics, wiring and solenoid valves and a mandrel for extending below for engagement with a central locking mechanism in a receiver baseplate.

U.S. Pat. No. 6,318,408 B1 to Y. Fukano et al. shows a directional control valve.

A method and apparatus hydraulic and electro-hydraulic control of subsea blowout preventer systems is disclosed in U.S. Pat. No. 6,484,806 B2 to M. Childers et al.

SUMMARY OF THE INVENTION

The pressure compensated shear seal solenoid valve of the present invention is designed for use in subsea hydraulic control systems for operating valves, blowout preventers and hydraulically actuated wellhead connectors. The pressure compensated shear seal solenoid valve includes a hydraulic section with a flow control member or piston for controlling fluid flow through the solenoid valve and a coil section that operates the piston. A manifold is positioned between the coil section and the hydraulic section with the coil section and the hydraulic section secured to the manifold.

The hydraulic section includes a valve body with fluid supply and outlet ports on an end face. An inlet flange and an outlet flange are secured to the valve body on opposite sides. Internal porting allows fluid communication between the inlet and outlet flanges and in turn with the fluid supply and outlet ports. A piston is positioned within the valve body and has a central bore therethrough. The piston is moveable between open and closed positions to control fluid communication between fluid supply and outlet ports. A supply seal plate and an outlet seal plate are positioned on opposite sides of the piston, with the outlet seal plate having an arcuate shaped fluid passageway to maximize flow rate while requiring a minimum amount of piston travel between its open and closed positions.

The coil section comprises a coil cover having a substantially cylindrical shape with a mounting flange disposed on one end with a solenoid section disposed within the coil cover. The solenoid section including an electrically operated coil, a fixed metal core and a moveable metal core axially positioned a predetermined axial distance from the fixed metal core. An end cap is arrayed on the coil cover on the opposite end from the mounting flange. A bore extends axially through the fixed metal core with a plunger positioned within the bore and extending from the bore a predetermined distance at either end. The plunger is impacted and moved by the moveable metal core when the electrically operated coil is energized and thereby moves the piston. A flux ring encircles a portion of the moveable core and is sealed thereto. A pair of electrical leads supply power to the electrically operated coil.

A principal object of the present invention is to provide a pressure compensated shear seal solenoid valve with an improved flow rate.

Another object of the present invention is to provide a pressure compensated shear seal solenoid valve that minimizes the piston travel required to open and close the valve.

A final object of the present invention is to provide a pressure compensated shear seal solenoid valve that allows the use of a smaller coil for its operation These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein:

FIG. 5 comprises a perspective view of the piston of the pressure compensated shear seal solenoid valve.

FIG. 6 comprises a full sectional perspective view of the piston of the pressure compensated shear seal solenoid valve of FIG. 5.

FIG. 7 comprises a perspective view of the outlet seal plate of the pressure compensated shear seal solenoid valve.

FIG. 8 comprises a full sectional perspective view of the outlet seal plate of the pressure compensated shear seal solenoid valve of FIG. 6.

DESCRIPTION OF THE PREFERRED EMBODIMENT

Figure 1:
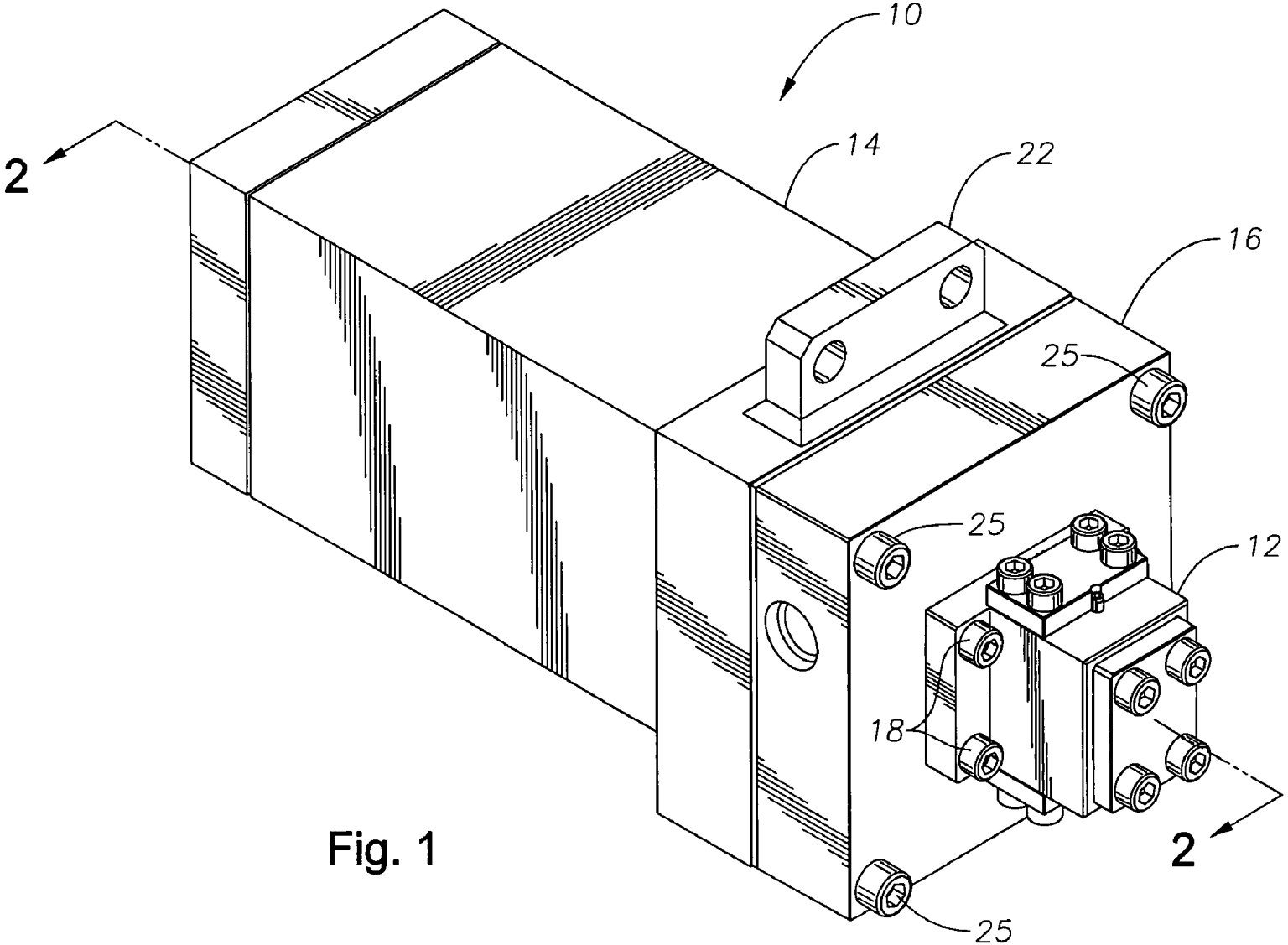
FIG. 1 comprises a perspective view of the pressure compensated shear seal solenoid valve.

With reference to the drawings, and particularly to FIG. 1 a perspective view of pressure compensated shear seal solenoid valve 10 of the present invention is shown. Pressure compensated shear seal solenoid valve 10 includes hydraulic section 12 and coil section 14. Hydraulic section 12 and coil section 14 are secured to manifold 16 that is positioned therebetween by suitable securing means as bolts 18 and 20, respectively. Attachment bracket 22 allows pressure compensated shear seal solenoid valve 10 to be secured to an appropriate support structure.

Figure 2A:
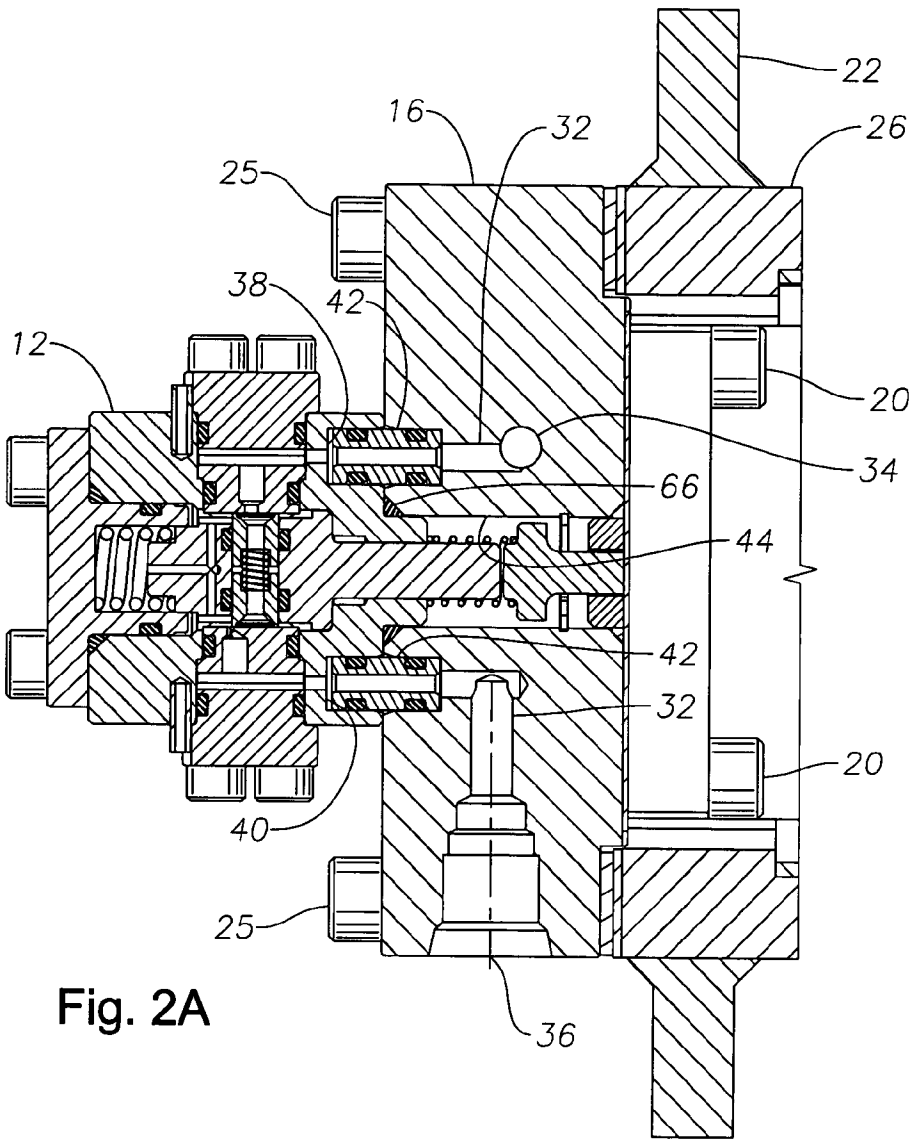
FIGS. 2A and 2B comprise a full sectional view of the pressure compensated shear seal solenoid valve taken along line 2—2 of FIG. 1.
Figure 2B:
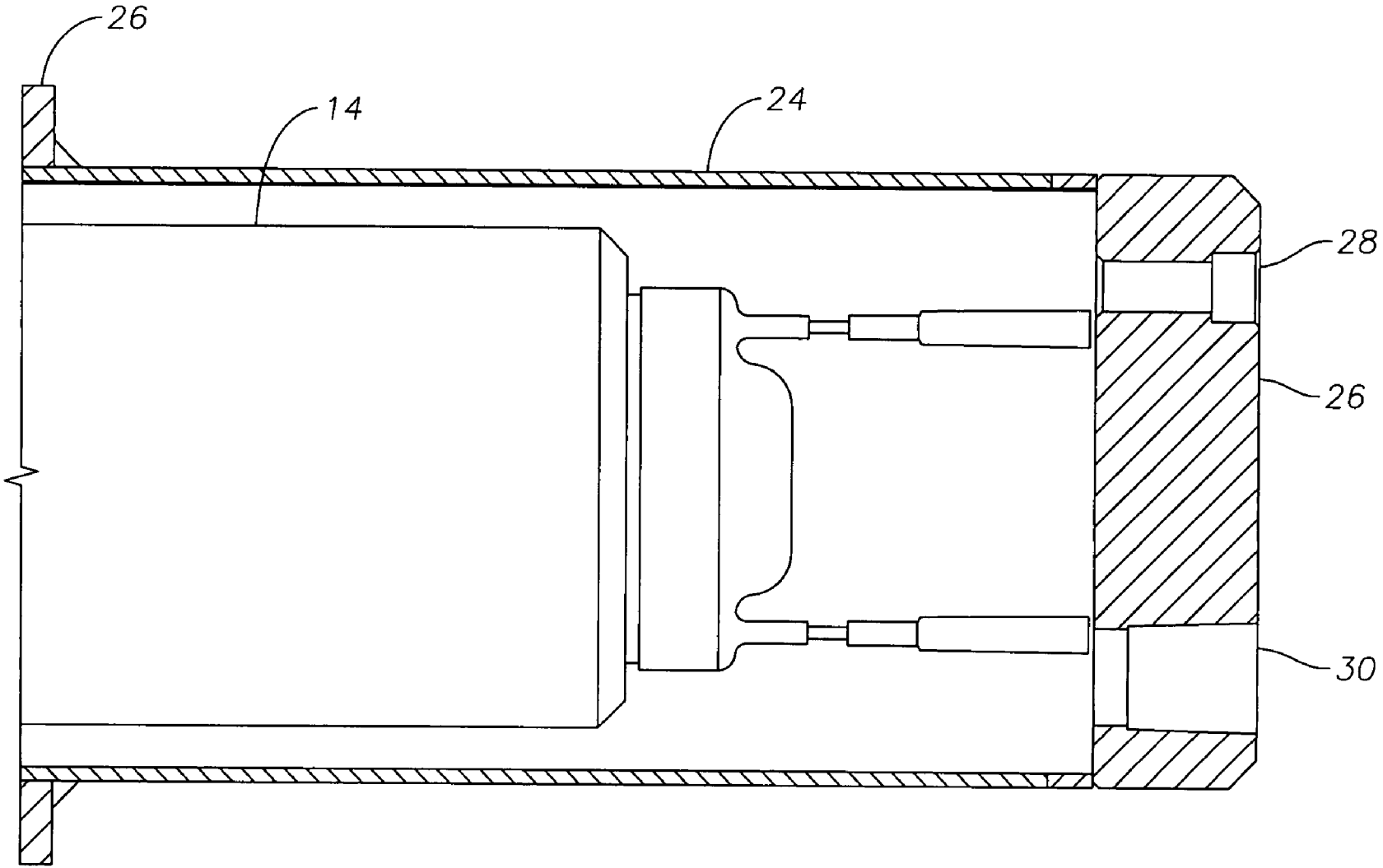

Pressure compensated shear seal solenoid valve 10 is shown in sectional view in FIG. 2. Coil section 14 is surrounded by outer compensation chamber 24 of a generally rectangular parallelepiped configuration with one of the ends secured to end section 26 by suitable means as welding. Bolts 25 secure outer compensation chamber 24 to manifold 16. Outer compensation chamber 24 includes fittings 28 and 30 for attachment of a pressure transducer and a pressure compensator accumulator bottle (not shown).

Manifold 16 includes internal passages 32 which connect to fluid supply and fluid outlet connections 34 and 36, respectively. Passages 32 connect to fluid supply and outlet ports 38 and 40 in hydraulic section 12. Passages 32 are sealed to fluid supply and outlet ports 38 and 40 by seal subs 42. Manifold 16 also includes plunger bore 44 centrally located therein for purposes to be explained hereinafter.

Figure 3:
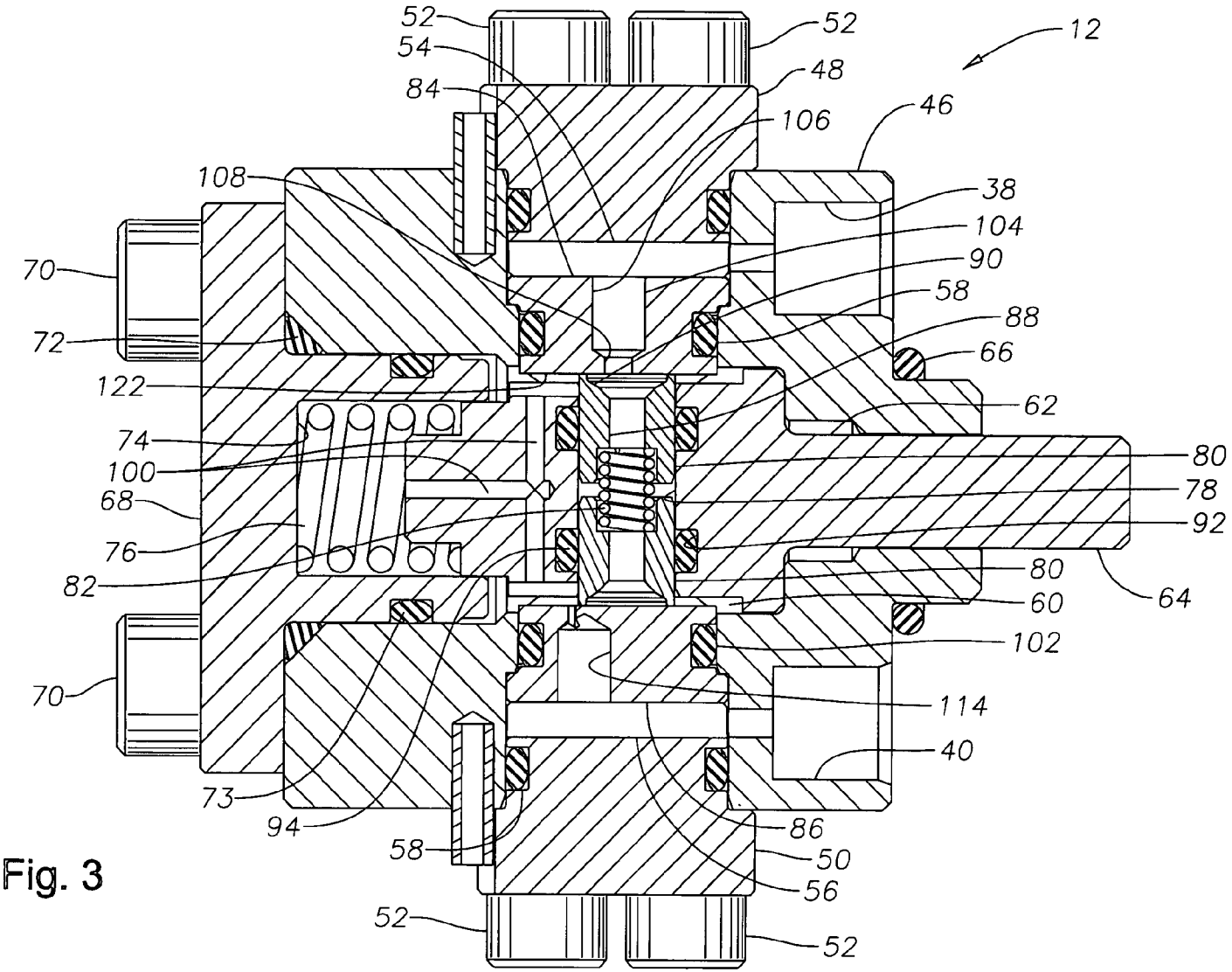
FIG. 3 comprises an enlarged sectional view of the hydraulic section of the pressure compensated shear seal solenoid valve of FIG. 2A in the closed position, with the coil deenergized.
Figure 4:
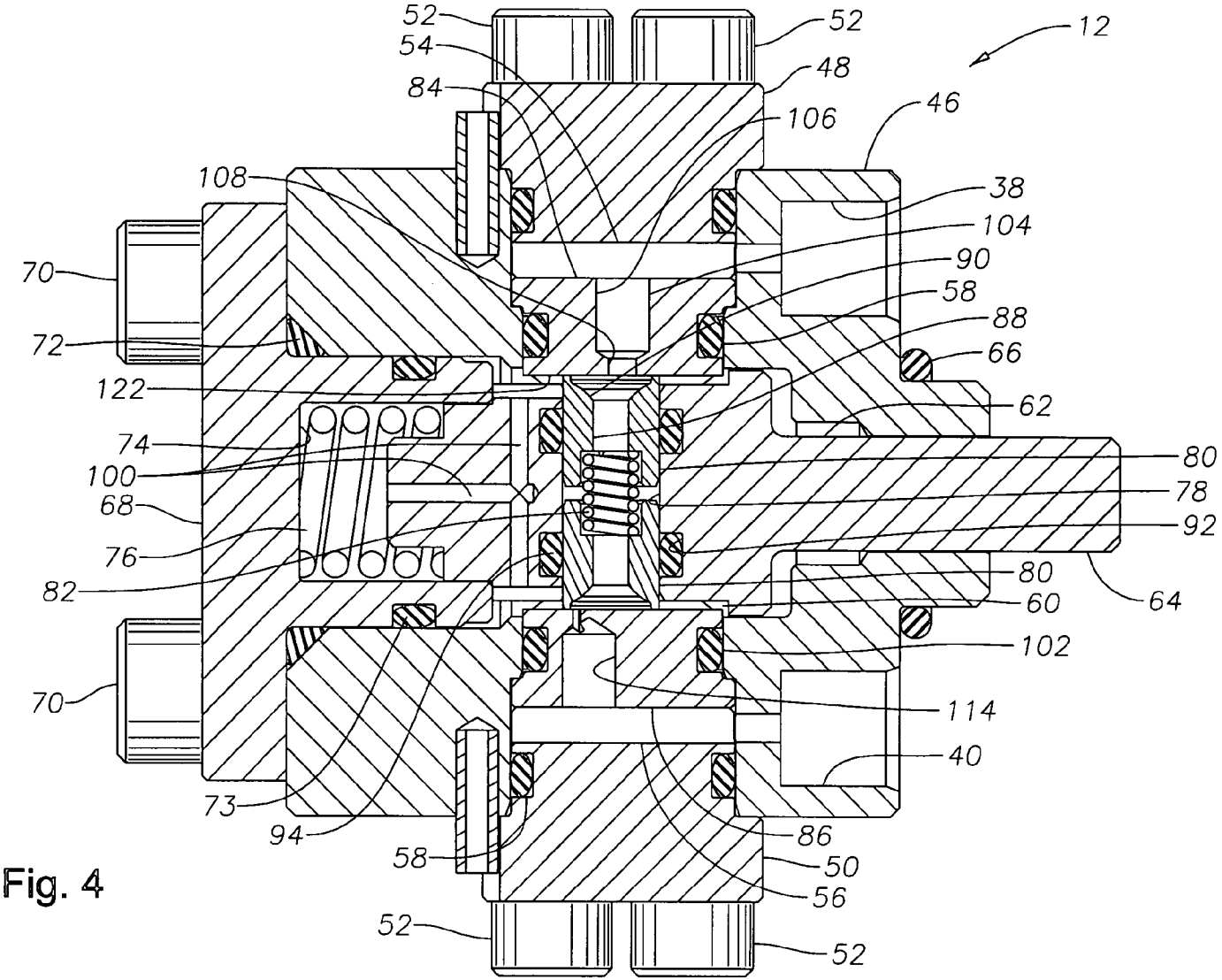
FIG. 4 comprises an enlarged sectional view of the hydraulic section of the pressure compensated shear seal solenoid valve of FIG. 2A in the open position, with the coil energized.

The details of construction of hydraulic section 12 are best seen in FIGS. 3 and 4. Hydraulic section 12 includes valve body 46 having fluid supply port 38 and fluid outlet port 40 formed therein. Inlet flange 48 and outlet flange 50 are secured to valve body 46 by bolts 52. Inlet flange 48 includes inlet flange fluid port 54 which communicates with fluid supply port 38 while outlet flange 50 includes outlet flange fluid port 56 which communicates with fluid outlet port 40. Seal rings in the form of O rings 58 ensure there is no leakage of pressurized hydraulic fluid from inlet flange fluid port 54 and outlet flange fluid port 56 to the outside.

Valve body 46 includes central chamber 60 in which piston 62 is disposed. Piston 62 includes piston neck 64 extending from valve body 46. Seal ring 66 is positioned on the exterior of valve body 46 and seals valve body 46 to manifold 16 when assembled. The opposite side of valve body 46 has end cap 68 secured thereto by bolts 70 and sealed by seal rings such as O rings 72 and 73. End cap 68 has recess 74 formed on its interior surface with piston spring 76 positioned therein. Piston 62 has central bore 78 therethrough, perpendicular to the axis of travel of piston 62. Shear seal rings 80 are disposed within central bore 78 with urging means in the form of coil spring 82 positioned therebetween to urge shear seal rings 80 outwardly toward supply and outlet seal plates 84 and 86, respectively. Shear seal rings 80 include central bore 88 therethrough with tapered inner diameters 90 formed at their outer ends. Central bore 78 of piston 62 includes seal grooves 92 formed therein with O rings 94 disposed in seal grooves 92 and sealing the exterior of shear seal rings 80.

Referring to FIGS. 5 and 6, details of construction of piston 62 are shown. Fluid vent groove 96 is formed in piston neck 64 and extends axially onto face 98 of piston 62. Fluid vent grooves 96 allow vented fluids from hydraulic section 12 to flow out of body central chamber 60 to a vent port in manifold 16 (not shown). Piston 62 includes fluid bleeder ports 100 formed as shown in FIGS. 3 and 5 for purposes to be explained hereinafter.

As shown in FIGS. 3 and 4, supply seal plate 84 and outlet seal plate 86 are generally cylindrical members with seal rings 102 on their exterior to seal within valve body 46. Supply seal plate 84 includes port 104 therethough allowing fluid communication between inlet flange fluid port 54 and central bore 88 of shear seal rings 80. Port 104 includes first fluid passageway 106 disposed on the side of supply seal plate 84 adjacent inlet flange fluid port 54 and is circular in cross section. Port 104 includes second fluid passageway 108 disposed on the side of supply seal plate 84 adjacent central bore 88 of shear seal rings 80 and is circular in cross section. First fluid passageway 106 and second fluid passageway 108 circular cross sections are of different diameters to give a gradual flow transition. When the circular cross section of second fluid passageway 108 of supply seal plate 84 is contained within the diameter of said tapered outlet face 90 of shear seal ring 80 when piston 62 is moved to an open position to allow fluid communication between inlet flange fluid port 54 and outlet flange fluid port 56.

Referring to FIGS. 7 and 8, details of construction of outlet seal plate 86 are shown. Outlet seal plate 86 includes port 110 therethough allowing fluid communication between central bore 88 of shear seal rings 80 and outlet flange fluid port 56. Port 110 includes first fluid passageway 112 disposed on the side of outlet seal plate 86 adjacent central bore 88 of shear seal rings 80 and is arcuate in cross section. Second fluid passageway 114 is disposed on the side of outlet seal plate 86 adjacent outlet flange fluid port 58 and is circular in cross section. The arcuate cross section of first fluid passageway 112 of outlet seal plate 86 has inner radius 116 and outer radius 118. Outer radius 118 of first fluid passageway 112 of outlet seal plate 86 is substantially equal to the inside radius of tapered outlet face 90 of shear seal rings 80. When piston 62 is moved to an open position to allow fluid communication between fluid supply port 38 and outlet port 40, outer radius 118 of arcuate cross section of first fluid passageway 112 of outlet seal plate 86 is substantially coincident to the inside radius of tapered outlet face 90 of shear seal ring 80. Inner face 120 of outlet seal plate 86 and inner face 122 of supply seal plate 84 are lapped to a polished finish to allow face to face sealing with shear seal ring 80.

Figure 9:
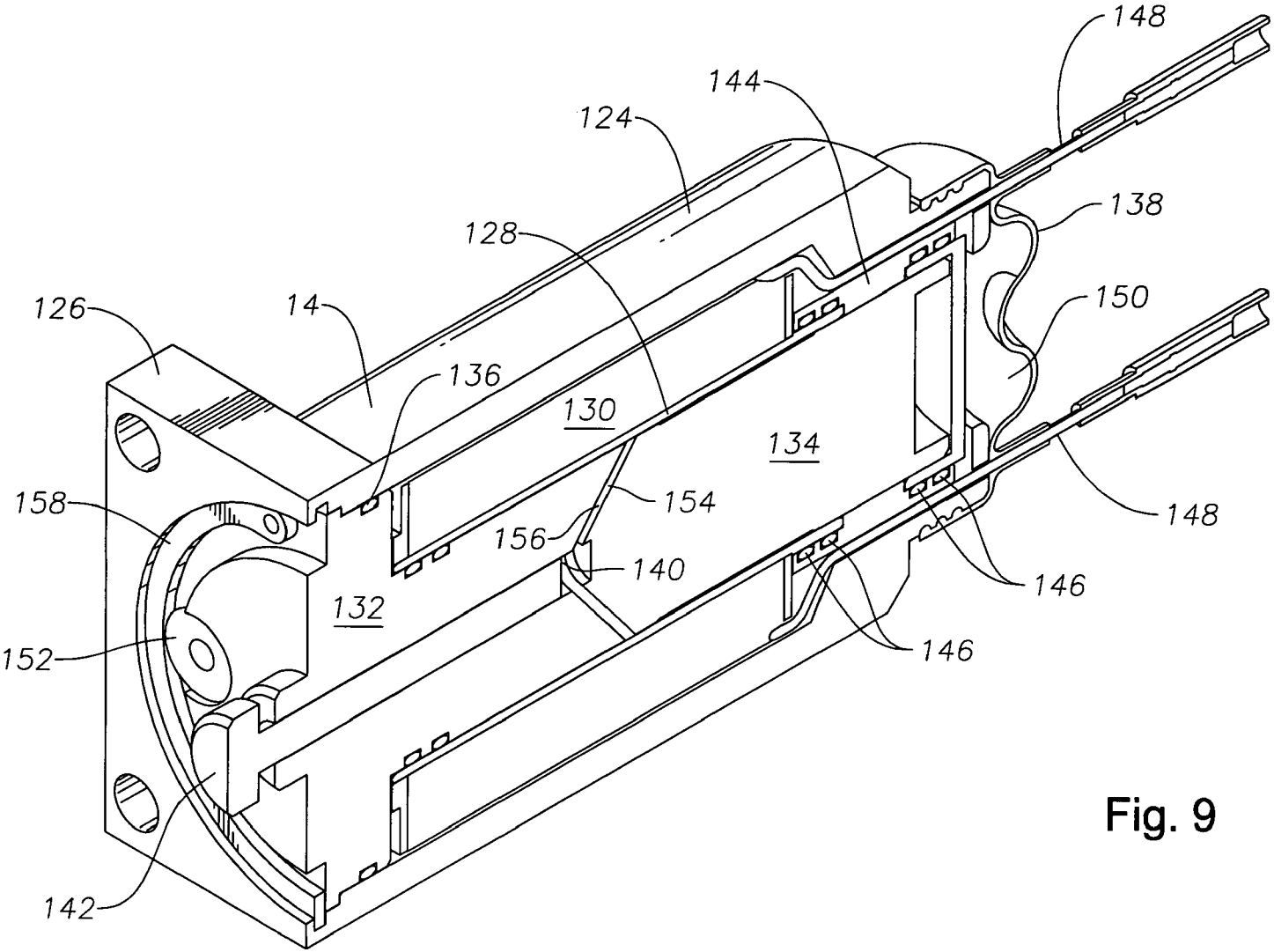
FIG. 9 comprises a full sectional perspective view of the coil section of the pressure compensated shear seal solenoid valve.

The details of construction of coil section 14 are best seen in FIG. 9. Coil section 14 includes coil cover 124 which has a substantially cylindrical shape with integral flange 126 disposed on one end. Solenoid section 128 is disposed within coil cover 124 and includes electrically operated coil 130, fixed metal core 132 and moveable metal core 134 axially positioned a predetermined axial distance from fixed metal core 132. Fixed metal core 132 sealed at one end to the interior of coil cover 124 by seal rings 136. Pressure transfer cap 138 is constructed of a suitable elastomeric material and is fitted on coil cover 124 on the opposite end from mounting flange 126. Pressure transfer cap 138 is expandible and collapsible to accommodate pressure changes within coil section 14.

Bore 140 extends axially through fixed metal core 132 and has plunger 142 positioned within bore 140. Plunger 142 extends from bore 140 a predetermined distance at either end and plunger 142 is impacted and moved by moveable metal core 134 when electrically operated coil 130 is energized. Flux ring 144 encircles a portion of moveable core 134 and is sealed thereto by a plurality of seal rings 146. Paired electrical leads 148 supply power to electrically operated coil 130. Electrical leads 148 extend through pressure transfer cap 138 and are sealed by pressure transfer cap 138. The interior of coil section 14 is filled with a predetermined amount of dielectric fluid 150 which displaces any air within coil section 14 and prevents ingress of foreign matter into coil section 14. Fill ports 152 provide a means for filling coil section 14 with dielectric fluid 150. Fixed metal core 132 and moveable metal core 134 have complimentary tapered faces 154 and 156 on their mating faces. Securing means in the form of snap ring 158 secures solenoid section 128 within coil cover 124.

A typical sequence of operation for pressure compensated shear seal solenoid valve 10 is as follows. Pressurized hydraulic fluid is supplied from a manifold of accumulator bottles, well known to those of ordinary skill in the art, to fluid supply connection 34 in manifold 16. The pressurized hydraulic fluid then flows through internal passage 32, through seal subs 42 to inlet flange fluid port 54 and to supply seal plate 84. The pressurized hydraulic fluid is then directed through shear seal rings 80 where the flow is stopped by outlet seal plate 86, if coil 130 is deenergized, as shown in FIG. 3. When it is desired to supply pressure to a control function, coil 130 is energized and piston 62 is moved to the position shown in FIG. 4, where the pressurized hydraulic fluid flows through first fluid passageway 112 which is arcuate shaped and to second fluid passageway 114 and thence to outlet flange fluid port 56, through seal subs 42 and internal passage 32 to fluid outlet connection 36. The pressurized hydraulic fluid then is directed through appropriate piping to the control function being operated.

Figure 10:
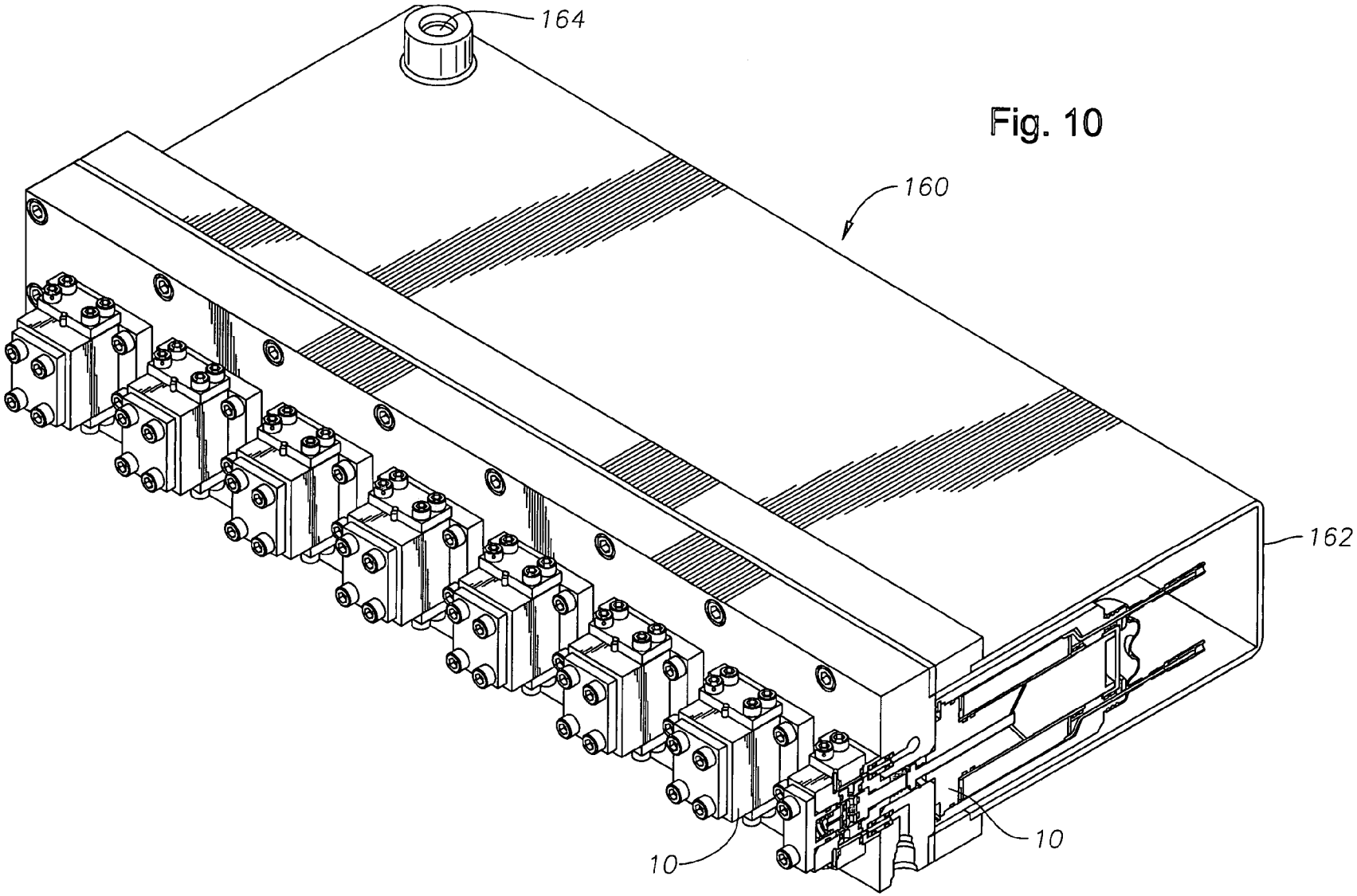
FIG. 10 comprises a full sectional perspective view of a plurality of the pressure compensated shear seal solenoid valves assembled into a manifold.

In a typical installation of pressure compensated shear seal solenoid valve 10, it is often desired to install a plurality of valves 10 in an integrated unit commonly referred to as a multi-function manifold. Such a manifold allows for the functioning of multiple subsea devices such as valves, blowout preventers and hydraulically actuated wellhead connectors. Construction details of such a typical unit using a plurality of pressure compensated shear seal solenoid valves 10 are shown in FIG. 10. Manifold assembly 160 includes an outer compensation chamber 162 with a plurality of pressure compensated shear seal solenoid valves 10 mounted along one edge. Fill port 164 is provided to allow dielectric fluid to be added to manifold assembly 160 to fill its interior and protect pressure compensated shear seal solenoid valves 10 mounted therein. Electrical leads 148 extend to the rear of manifold assembly 160 for connection to the appropriate controls. Manifold assembly 160 can then be mounted in a convenient location on a subsea hydraulic control system to facilitate routing of the necessary piping.

The construction of our pressure compensated shear seal solenoid valve will be readily understood from the foregoing description and it will be seen that we have provided a pressure compensated shear seal solenoid valve that offers an improved flow rate and ease of serviceability. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A hydraulic section for a solenoid valve, comprising:

a valve body, said valve body having fluid supply and outlet ports on an end face;

an inlet flange and an outlet flange secured to said valve body, each of said inlet and outlet flanges including a fluid port, said inlet flange fluid port communicating with said fluid supply port and said outlet flange fluid port communicating with said fluid outlet port;

a piston disposed within said valve body, said piston having a central bore therethrough, said piston moveable between open and closed positions to control fluid communication between said fluid supply and outlet ports;

a pair of shear seal rings sealingly disposed within said piston bore, said shear seal rings having a central bore therethrough; and a supply seal plate and an outlet seal plate, said supply seal plate having a port therethough allowing fluid communication between said inlet flange fluid port and said shear seal rings central bore, said outlet seal plate having a port therethough allowing fluid communication between said outlet flange fluid port and said shear seal rings central bore.

2. A hydraulic section for a solenoid valve, according to claim 1, including:

a piston spring disposed within said valve body and coaxial with said piston;

an end cap secured to said valve body, said end cap maintaining said piston spring in engagement with said piston; and said piston spring urging said piston to a closed position.

3. A hydraulic section for a solenoid valve, according to claim 2, wherein:

said pair of shear seal rings having a spring coaxially positioned between said pair of shear seal rings to urge said shear seal rings into sealing engagement with said supply and outlet seal plates, and each of said pair of shear seal rings has a tapered inner diameter.

4. A hydraulic section for a solenoid valve, according to claim 3, wherein:

said outlet seal plate port therethough allowing fluid communication between said outlet flange fluid port and said shear seal rings central bore includes first and second fluid passages disposed on opposite sides of said outlet seal plate and allowing fluid flow therebetween;

said first fluid passageway is disposed on the side of said outlet seal plate adjacent said shear seal rings central bore and said first fluid passage way is arcuate in cross section; and said second fluid passageway is disposed on the side of said outlet seal plate adjacent said outlet flange fluid port and said second fluid passage way is circular in cross section.

5. A hydraulic section for a solenoid valve, according to claim 4, wherein:

said tapered inner diameters of said shear seal rings face said supply seal plate and said outlet seal plate.

6. A hydraulic section for a solenoid valve, according to claim 5, wherein:

said arcuate cross section of said first fluid passageway of said outlet seal plate has an inner and an outer radius; and said outer radius of said arcuate cross section of said first fluid passageway of said outlet seal plate is substantially equal to the radius of said tapered outlet face of said shear seal rings.

7. A hydraulic section for a solenoid valve, according to claim 6, wherein:

said outer radius of said arcuate cross section of said first fluid passageway of said outlet seal plate is substantially coincident to the radius of said tapered outlet face of said shear seal ring when said piston is moved to an open position to allow fluid communication between said fluid supply and outlet ports.

8. A hydraulic section for a solenoid valve, according to claim 7, wherein:

said piston has a plurality of seal rings disposed in said central bore therethrough; and said plurality of seal rings sealing the annulus between said piston bore and the exterior of said shear seal rings disposed in said piston bore.

9. A hydraulic section for a solenoid valve, according to claim 8, wherein:

said supply seal plate port therethough allowing fluid communication between said inlet flange fluid port and said shear seal rings central bore includes first and second fluid passages disposed on opposite sides of said supply seal plate and allowing fluid flow therebetween;

said first fluid passageway is disposed on the side of said supply seal plate adjacent said inlet flange fluid port and said first fluid passage way is circular in cross section; and said second fluid passageway is disposed on the side of said supply seal plate adjacent said shear seal rings central bore and said second fluid passageway is circular in cross section.

10. A hydraulic section for a solenoid valve, according to claim 9, wherein:

said circular cross sections of said first and second fluid passages of said supply seal plate are of different diameters.

11. A hydraulic section for a solenoid valve, according to claim 10, wherein:

said circular cross section of said first fluid passageway of said supply seal plate is contained within the diameter of said tapered outlet face of said shear seal ring when said piston is moved to an open position to allow fluid communication between said fluid supply and outlet ports.

12. A solenoid valve, comprising:

a hydraulic section having a moveable piston for controlling fluid flow between a fluid supply and a controlled apparatus;

a coil section moving said moveable piston between open and closed positions in response to an electrical signal;

a manifold positioned between said coil section and said hydraulic section, said coil section and said hydraulic section secured to said manifold;

said hydraulic section comprising:

a valve body, said valve body having fluid supply and outlet ports on an end face;

an inlet flange and an outlet flange secured to said valve body, each of said inlet and outlet flanges including a fluid port, said inlet flange fluid port communicating with said fluid supply port and said outlet flange fluid port communicating with said fluid outlet port;

a piston disposed within said valve body, said piston having a central bore therethrough, said piston moveable between open and closed positions to control fluid communication between said fluid supply and outlet ports;

a pair of shear seal rings sealingly disposed within said piston bore, said shear seal rings having a central bore therethrough;

a supply seal plate and an outlet seal plate, said supply seal plate having a port therethough allowing fluid communication between said inlet flange fluid port and said shear seal rings central bore, said outlet seal plate having a port therethough allowing fluid communication between said outlet flange fluid port and said shear seal rings central bore; and said coil section comprising:

a coil cover, said coil cover having a substantially cylindrical shape with a mounting flange disposed on one end;

a solenoid section disposed within said coil cover, said solenoid section including an electrically operated coil, a fixed metal core and a moveable metal core axially positioned a predetermined axial distance from said fixed metal core, said fixed metal core sealed at one end to the interior of said coil cover;

a pressure transfer cap arrayed on said coil cover on the opposite end from said mounting flange;

a bore extending axially through said fixed metal core;

a plunger positioned within said bore and extending from said bore a predetermined distance at either end, said plunger being impacted and moved by said moveable metal core when said electrically operated coil is energized;

a flux ring encircling a portion of said moveable core and sealed thereto; and a pair of electrical leads supplying power to said electrically operated coil.

13. A solenoid valve, according to claim 12, wherein:

said hydraulic section further comprises:

a piston spring disposed within said valve body and coaxial with said piston;

an end cap secured to said valve body, said end cap maintaining said piston spring in engagement with said piston;

said piston spring urging said piston to a closed position; and said coil section further comprises:

said pressure transfer cap which is deformable to accommodate pressure changes within said coil section.

14. A solenoid valve, according to claim 13, wherein:

said hydraulic section further comprises:

said pair of shear seal rings having a spring coaxially positioned between said pair of shear seal rings to urge said shear seal rings into sealing engagement with said supply and outlet seal plates;

each of said pair of shear seal rings has a tapered inner diameter; and said coil section further comprises:

said pair of electrical leads extending through said pressure transfer cap and being sealed by said pressure transfer cap.

15. A solenoid valve, according to claim 14, wherein:

said hydraulic section further comprises:

said outlet seal plate port therethough allowing fluid communication between said outlet flange fluid port and said shear seal rings central bore includes first and second fluid passages disposed on opposite sides of said outlet seal plate and allowing fluid flow therebetween;

said first fluid passageway is disposed on the side of said outlet seal plate adjacent said shear seal rings central bore and said first fluid passage way is arcuate in cross section;

said second fluid passageway is disposed on the side of said outlet seal plate adjacent said outlet flange fluid port and said second fluid passage way is circular in cross section; and said coil section further comprises:

a predetermined amount of dielectric fluid within said coil section, said dielectric fluid displacing any air within said coil section, and preventing ingress of foreign matter into said coil section.

16. A solenoid valve, according to claim 15, wherein:

said hydraulic section further comprises:

said tapered inner diameters of said shear seal rings face said supply seal plate and said outlet seal plate; and said coil section further comprises;

said fixed metal core and said moveable metal core having complimentary tapered faces on their mating faces.

17. A solenoid valve, according to claim 16, wherein:

said hydraulic section further comprises:

said arcuate cross section of said first fluid passageway of said outlet seal plate having an inner and an outer radius;

said outer radius of said arcuate cross section of said first fluid passageway of said outlet seal plate is substantially equal to the radius of said tapered outlet face of said shear seal rings; and said coil section further comprises:

securing means securing said solenoid section within said coil cover.

18. A solenoid valve, according to claim 17, wherein:

said hydraulic section further comprises:

said outer radius of said arcuate cross section of said first fluid passageway of said outlet seal plate is substantially coincident to the radius of said tapered outlet face of said shear seal ring when said piston is moved to an open position to allow fluid communication between said fluid supply and outlet ports; and said coil section further comprises:

a plurality of fill ports for filling said coil section with said dielectric fluid.

19. A solenoid valve, according to claim 18, wherein:

said hydraulic section further comprises:

said piston having a plurality of seal rings disposed in said central bore therethrough; and said plurality of seal rings sealing the annulus between said piston bore and the exterior of said shear seal rings disposed in said piston bore.

20. A solenoid valve, according to claim 19, wherein:

said hydraulic section further comprises:

said supply seal plate port therethough allowing fluid communication between said inlet flange fluid port and said shear seal rings central bore includes first and second fluid passages disposed on opposite sides of said supply seal plate and allowing fluid flow therebetween;

said first fluid passageway is disposed on the side of said supply seal plate adjacent said inlet flange fluid port and said first fluid passage way is circular in cross section; and said second fluid passageway is disposed on the side of said supply seal plate adjacent said shear seal rings central bore and said second fluid passageway is circular in cross section.

21. A solenoid valve, according to claim 20, wherein:

said hydraulic section further comprises:

said circular cross sections of said first and second fluid passages of said supply seal plate are of different diameters.

22. A solenoid valve, according to claim 21, wherein:

said hydraulic section further comprises;

said circular cross section of said first fluid passageway of said supply seal plate is contained within the diameter of said tapered outlet face of said shear seal ring when said piston is moved to an open position to allow fluid communication between said fluid supply and outlet ports.

* * * * *